US007261575B2

(12) United States Patent
Buchter et al.

(10) Patent No.: US 7,261,575 B2
(45) Date of Patent: Aug. 28, 2007

(54) ELECTRICAL CONNECTOR AND ELECTRICAL CONNECTOR ASSEMBLY HAVING SELECTIVELY INCLUDABLE LEVER ASSIST

(75) Inventors: Bradley S Buchter, East Berlin, PA (US); John R Shuey, Mechanicsburg, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/075,497

(22) Filed: Mar. 9, 2005

(65) Prior Publication Data

US 2006/0205262 A1 Sep. 14, 2006

(51) Int. Cl.
*H01R 13/62* (2006.01)
*H01R 13/627* (2006.01)

(52) U.S. Cl. ..... 439/157; 439/358

(58) Field of Classification Search ..... 439/157, 439/372, 350–358, 542, 160
See application file for complete search history.

(56) References Cited

U.S. PATENT DOCUMENTS 4,682,836 A 7/1987 Noorily et al.
4,711,507 A 12/1987 Noorily
4,711,511 A 12/1987 Noorily
5,474,461 A * 12/1995 Saito et al. ..... 439/157
5,833,484 A 11/1998 Post et al.
6,120,308 A * 9/2000 Hayashi ..... 439/157
6,413,105 B2 * 7/2002 Noro et al. ..... 439/157
6,644,992 B2 * 11/2003 Maegawa ..... 439/157
6,692,274 B2 * 2/2004 Maegawa ..... 439/157
2006/0205254 A1 * 9/2006 Foltz et al. ..... 439/157
2006/0205262 A1 * 9/2006 Buchter et al. ..... 439/358

* cited by examiner

*Primary Examiner*—James R. Harvey

(57) ABSTRACT

A connection system is shown where a lever-assist member may be added to assist in the mating between two connector housings as is needed depending upon a number of connector terminals loaded and the mating force between them. The lever-assist member is also locked in place by the interaction of the pivot-assist member and the corresponding latching structure of the connectors. The lever-assist member, when moved into the disconnection condition, has a projection which holds the cantilever beam arm of the latch in a position allowing the two connectors to be disconnected, which does not require the user to continue depressing the latch at the same time as rotating the pivot-assist member.

10 Claims, 17 Drawing Sheets

ELECTRICAL CONNECTOR AND ELECTRICAL CONNECTOR ASSEMBLY HAVING SELECTIVELY INCLUDABLE LEVER ASSIST

BACKGROUND OF THE INVENTION

The subject invention relates to an electrical connector design and an electrical connector assembly providing the alternative to have or not have a mating-assist lever to assist in the mating of two joining electrical connector halves.

In several different applications or industries, particularly in the automotive industry, electrical connector designs are standardized on various different harnesses or on various different discrete ends of a particular harness.

Just by way of example, it is common to provide as part of a wiring harness, wiring which extends into the automobile body, for example, and be connected to a mating connector at or under the driver's seat. Such connections can be used for the power seat having multiple ways of adjustment including up, back, tilt, and lumbar, as well as providing the opportunity for multiple variances of seat heating. In such an example, it would be common to provide multiple sizes of terminals depending on the power or amperage that needs to run through the cable, and thus the connectors need to accommodate multiple sizes of terminals as well.

It is also common that the connectors themselves are standardized to provide the maximum number of terminals required to accommodate all of the terminals for the maximum number of features allowable, but in the case where the seat heater or the electrical adjustment is not required, those particular terminals are not loaded. Thus, it is also common in the industry to have identical connector housings with a variety of different mating forces depending on the number of electrical terminals actually loaded in the mating connectors.

It is also common in the industry to have standardized maximum mating forces which are allowable for the assembly line in automobile plants. One such standard, known as USCAR, has designated 75 Newtons as a maximum mating force. USCAR is an umbrella organization made up of automotive manufacturers for joint research. This is the maximum force that can be designed into a connector assembly, where the two connectors are mated into a latched condition by hand including no assistance in the connection. Above the 75-Newton requirement, some type of mating assistance between the two connectors is required.

The object then of the present invention is to provide a connector design having a plurality of alternatives to accommodate all of the above-mentioned requirements.

SUMMARY OF THE INVENTION

The objects have been accomplished by providing an electrical connector assembly, comprising a first connector housing, having a first exterior profile, the exterior profile having at least a pair of engageable lugs positioned adjacent to a leading edge of the first connector housing. A first latch member is positioned adjacent to the leading edge of the first connector housing. At least one first contact member is positioned within the first connector housing. A second connector housing comprises a second exterior profile, profiled for overlappingly receiving the first exterior profile. A pair of channels is included to receive the at least one pair of engageable lugs on the first connector housing. A second latch member is positioned for latching engagement with the first latch member of the first connector housing. At least one second contact member is positioned therein, for mate able connection with the first contact member. The pair of channels have any one of a plurality of configurations, wherein the plurality of configurations include: each channel including a solid exterior wall which receives one of the pair of engageable lugs therein; or each channel may include a mounting wall having a mating assist member attached thereto, where the mating assist member is functional with the pair of engageable lugs to move the first and second connector housings into mated condition.

The first latch member may be profiled as a cantilever beam extending rearwardly away from the leading edge. The second latch member may be comprised of a raised wall, the cantilever beam of the first latch member being receivable into an area beneath the raised wall. The first and second latch members may also include first and second joining latch projections. The first latching projection may project upwardly from the cantilever beam, and the second latching projection may project downwardly from the raised wall. The pair of engageable lugs may be positioned on side walls of the first connector housing, and the first latch extends from a top wall.

The mating assist member may be a lever arm. The lever arm may be comprised of side arms attached to the mounting wall, and an upper arm spanning across the top wall. The lever arm may snap in place behind the cantilever beam when in the fully mated position. The engageable lugs and the lever arm may be profiled as rack and pinion teeth.

An inventive method of manufacturing an electrical connector assembly, comprises the steps of providing a first connector housing having a first exterior profile, where the exterior profile has at least one engageable lug positioned adjacent to a leading edge of the first connector housing. The first connector housing is provided with at least one first contact member therein. A second connector housing is provided having a second exterior profile profiled for overlappingly receiving, the first exterior profile. The second connecting housing has at least one second contact member therein, for mate able connection with the first contact member. A channel is provided on the second connector housing to receive the at least one engageable lug. A mounting wall is provided on the connector housing for an optional mating assist member. The method also includes selectively determining if a mating assist member is required on the basis of the anticipated mating force between the first and second connector housings, and if selected, mounting a mating assist member on the mounting wall in position for engagement with the at least one engageable lug.

The first latch member may be profiled as a cantilever beam extending rearwardly away from the leading edge. The second latch member may be comprised of a raised wall. The cantilever beam of the first latch member is receivable into an area beneath the raised wall. The first and second latch members may include first and second cooperating latching projections. The first latching projection may project upwardly from the cantilever beam, and the second latching projection may project downwardly from the raised wall. The pair of engageable lugs may be positioned on side walls of the first connector housing, and the first latch may extend from a top wall.

The mating assist member may be a lever arm, comprised of side arms attached to the mounting wall, and an upper arm spanning across the top wall. The lever arm may snap in place behind the cantilever beam when in the fully mated position. The engageable lugs and the lever arm may be profiled as rack and pinion teeth.

DESCRIPTION OF THE PREFERRED EMBODIMENT

Figure 1:
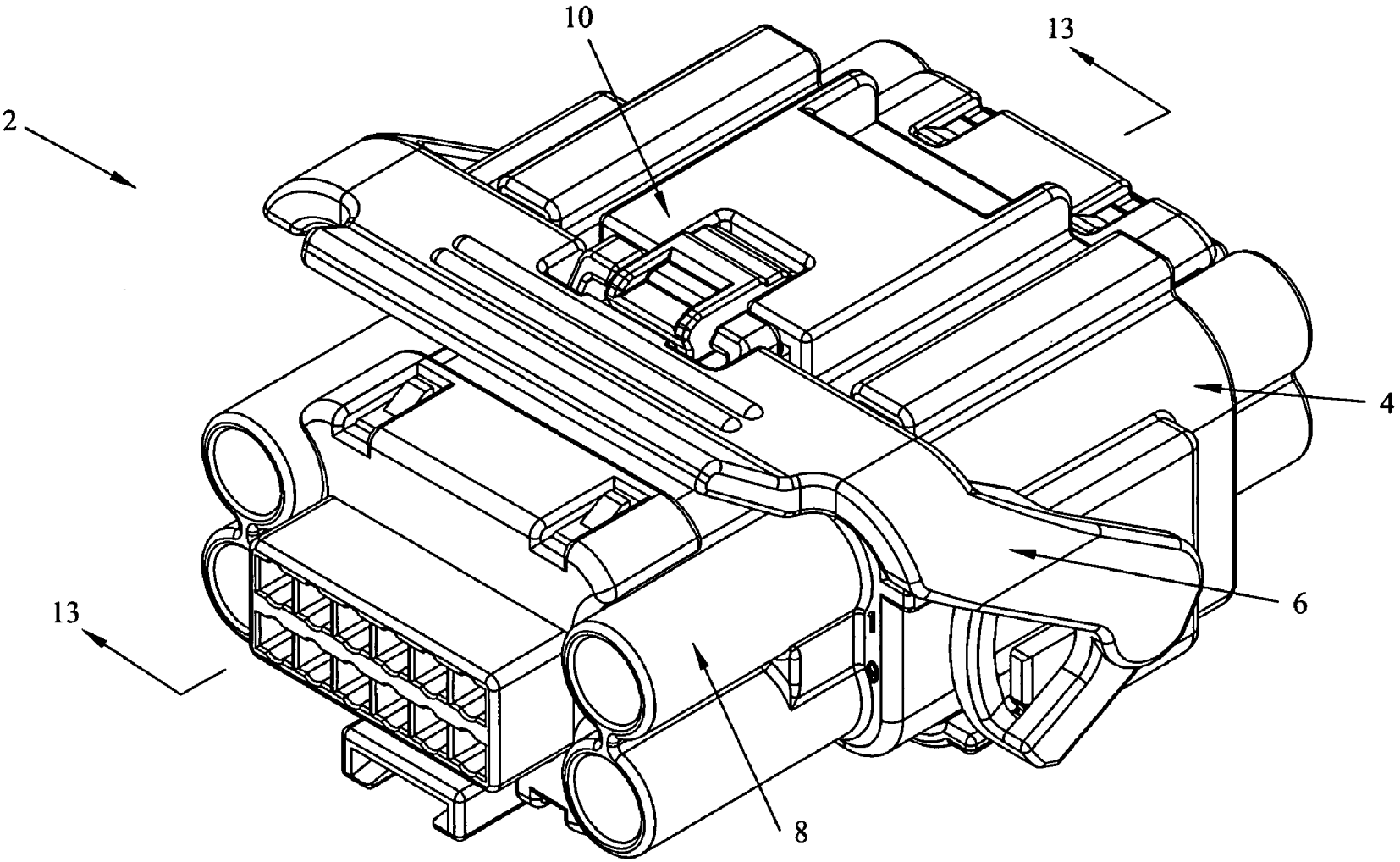
FIG. 1 is a perspective view showing the connector assembly in a mated condition.
Figure 2:
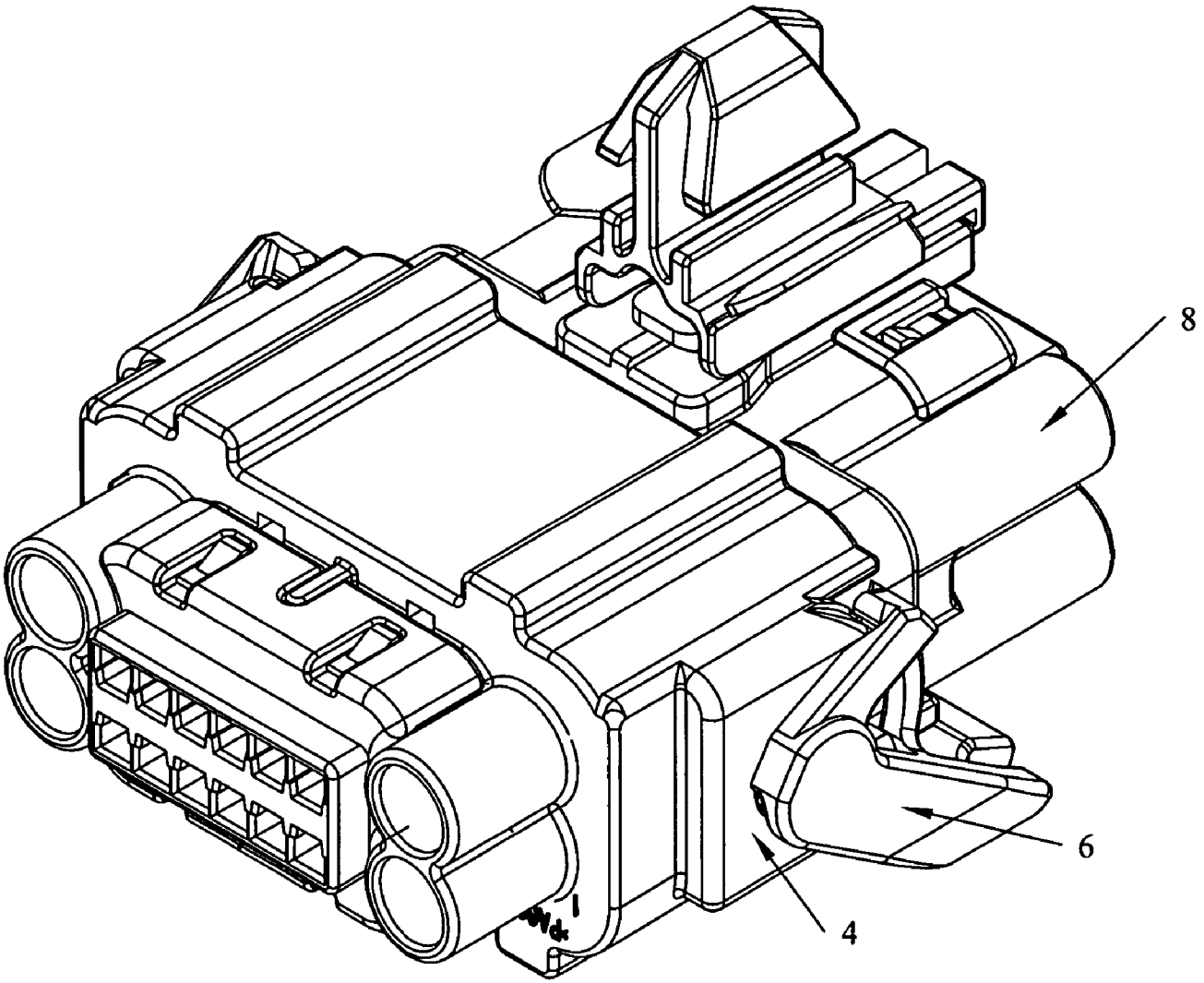
FIG. 2 is an underside perspective view of FIG. 1.

With respect first to FIGS. 1 and 2, an electrical connector assembly is shown as 2, which comprises a plug connector assembly 4 with a mating assist member 6, shown here as a lever or lever arm, interconnected to a header connector assembly shown at 8. The two connector assemblies 4, 8 are held together by a latch assembly shown generally at 10 and which will be described in greater detail herein.

Figure 3:
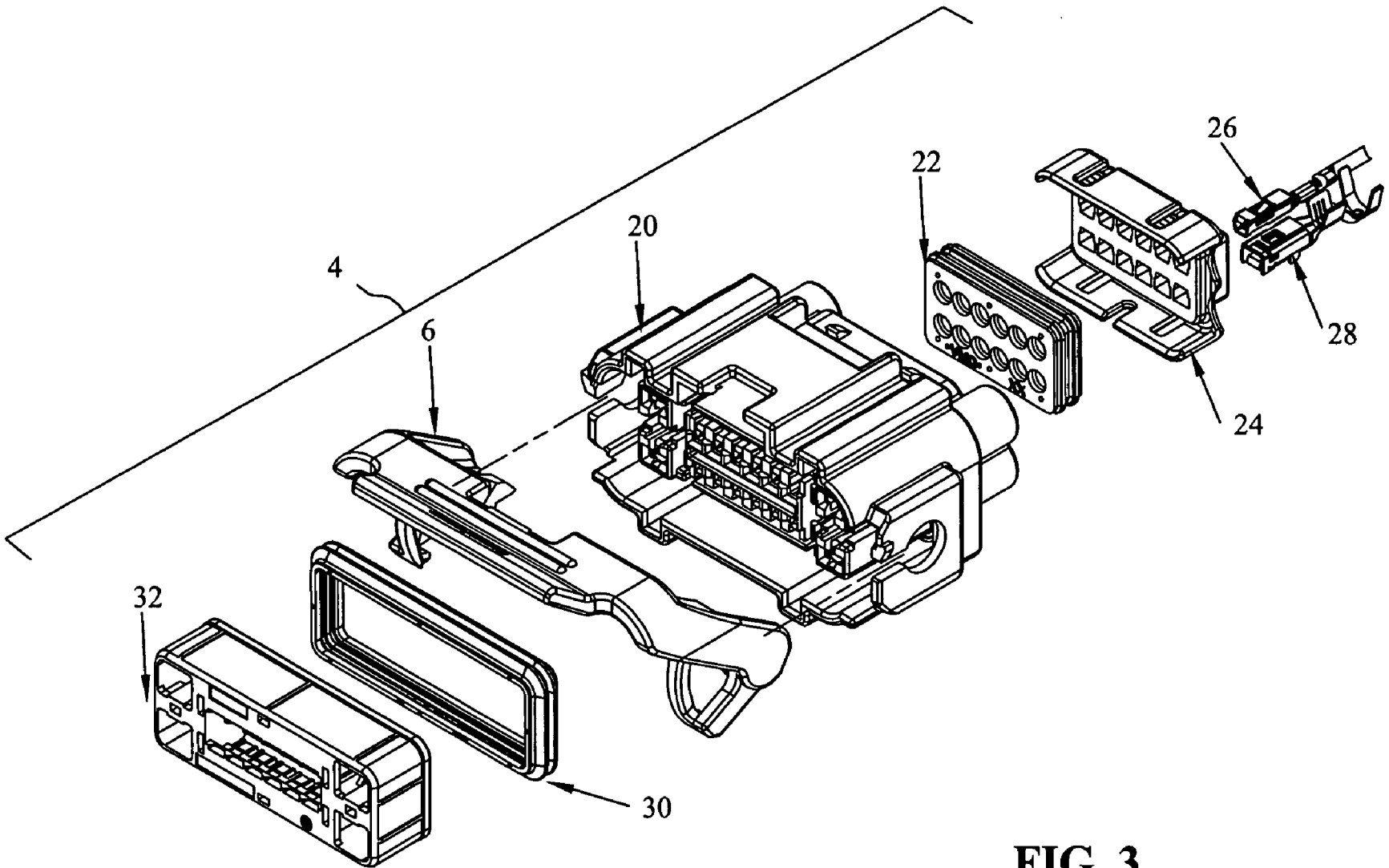
FIG. 3 shows an exploded view of the entire plug assembly of the embodiment of FIG. 1.

With respect now to FIG. 3, the plug or female connector assembly 4 is shown in an exploded manner, where mating assist member 6 is exploded away from its associated connector housing 20, and where a rear wire seal 22 and rear cover 24 are also shown together with contacts or terminals 26 and 28. On the front side of the connector housing 20, a front seal 30 and a terminal position assurance member 32 are shown exploded from the front side of connector housing 20.

Figure 4:
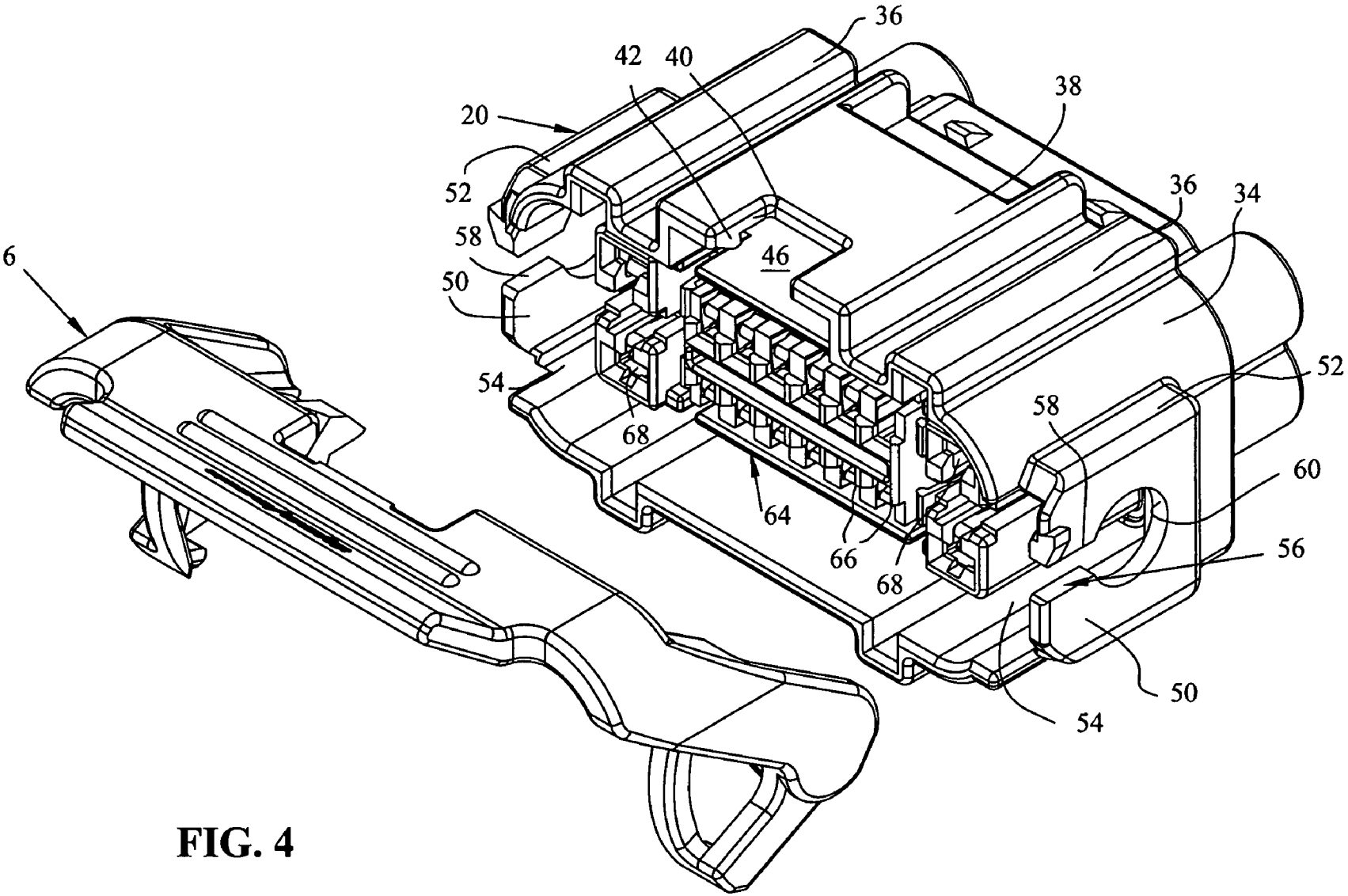
FIG. 4 shows an exploded view of the lever-assist plug housing in greater detail.

With reference now to FIG. 4, connector housing 20 and mating assist member 6 are shown exploded from each other, and connector housing 20 is shown in greater detail. Housing 20 generally includes an exterior profile defined by an outer shroud 34, which includes alignment channels 36, and further includes a central raised wall at 38. This central raised wall 38 includes a central notch at 40, with a latching mechanism in the form of locking projections 42 (only one of which can be viewed in FIG. 4) extending downwardly from the central raised wall 38 along the perimeter of notch 40, as will be further described herein. Raised wall 38 is spaced above an inner wall 46, and defines an opening therebetween for receipt of a mating latch as will also be described in greater detail herein.

With respect still to FIG. 4, connector housing 20 further includes a pair of mounting walls 50 connected to the connector housing 20 by side walls 52, separating mounting walls 50 from an inner portion of housing 20 and defining channels 54 therein. Mounting walls 50 further include mounting slots shown generally at 56, each including a narrowed passageway 58 opening into an enlarged circular bearing 60.

The connector housing 20 also includes a conventional internal housing portion at 64 having a plurality of terminal cavities, such as 66, for smaller electrical terminals and enlarged cavities at 68, for larger current carrying capacity electrical terminals.

Figure 6:
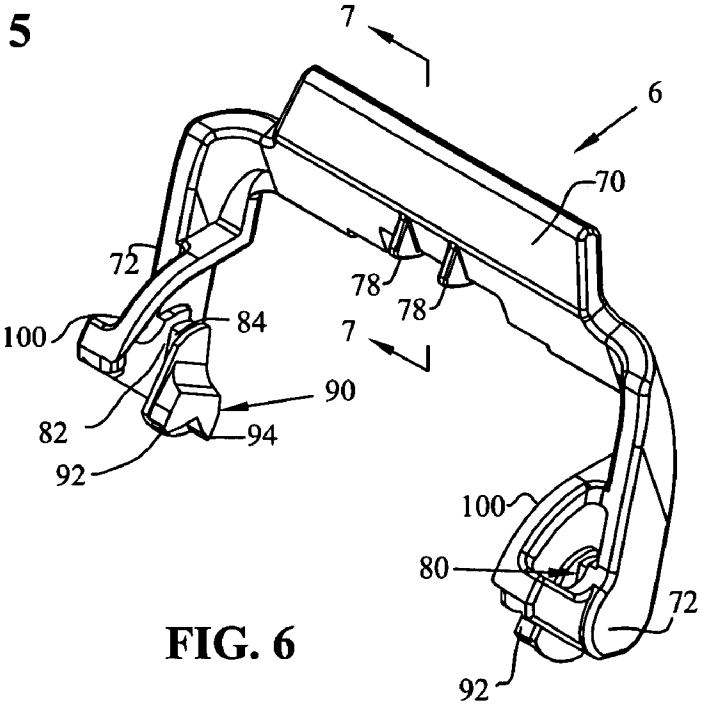
FIGS. 5 and 6 show alternative perspective views of the mating assist lever shown in FIG. 4.
Figure 5:
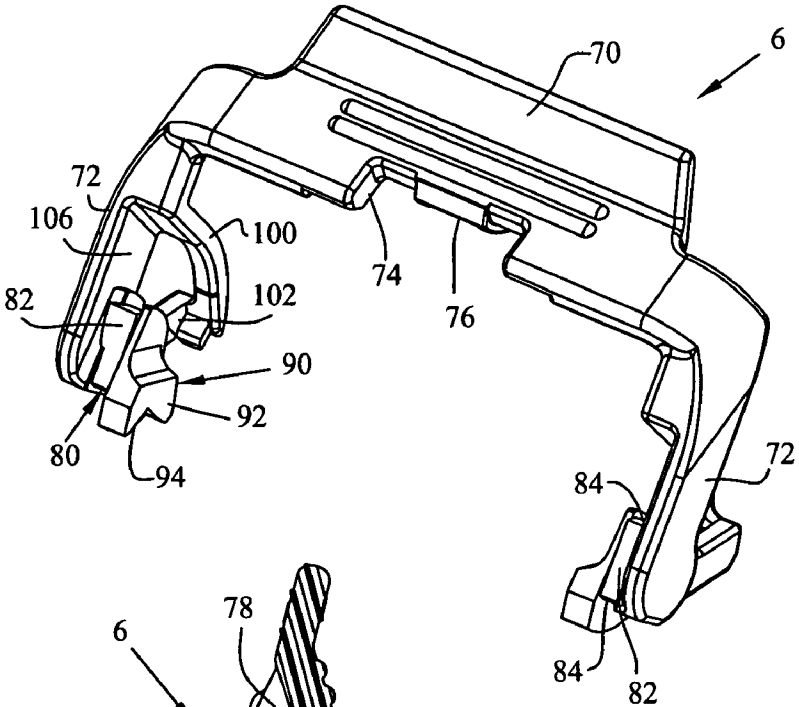
Figure 7:
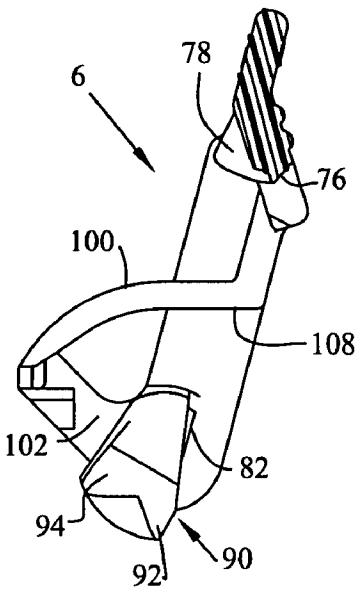
FIG. 7 shows a cross-sectional view through FIGS. 7-7 of FIG. 6.

With respect now to FIGS. 5 through 7, mating assist member 6 is comprised of an upper arm at 70 having side arms at 72. Upper arm 70 includes a notched portion at 74, which includes a first latching projection at 76, positioned at a trailing edge of the upper arm 70. As best shown in FIGS. 5 and 7, mating assist member 6 further includes at least one contoured surface to assist in releasing the latch assembly 10, shown here as two release projections 78 in FIGS. 6 and 7. With respect to FIGS. 5 and 6, mating assist member 6 further includes an axle portion at 80 including parallel and opposed flat surfaces 82, with upper and lower circular portions at 84.

With respect now to FIGS. 5 and 7, the mating assist member 6 further includes a pinion portion 90 having drive teeth 92 and 94. As shown in FIGS. 5 through 7, mating assist member 6 further includes an arcuate arm portion 100 connected to the side arms 72 via an arm portion 102, as best shown in FIG. 7. Arcuate arm portion 100 is spaced away somewhat from side walls 72 and positioned above axle portion 80 so as to cause an entry opening at 106, as best seen in FIG. 5. Arcuate arm portion 100 includes an inner contact surface at 108, as will be described in further detail.

Figure 8:
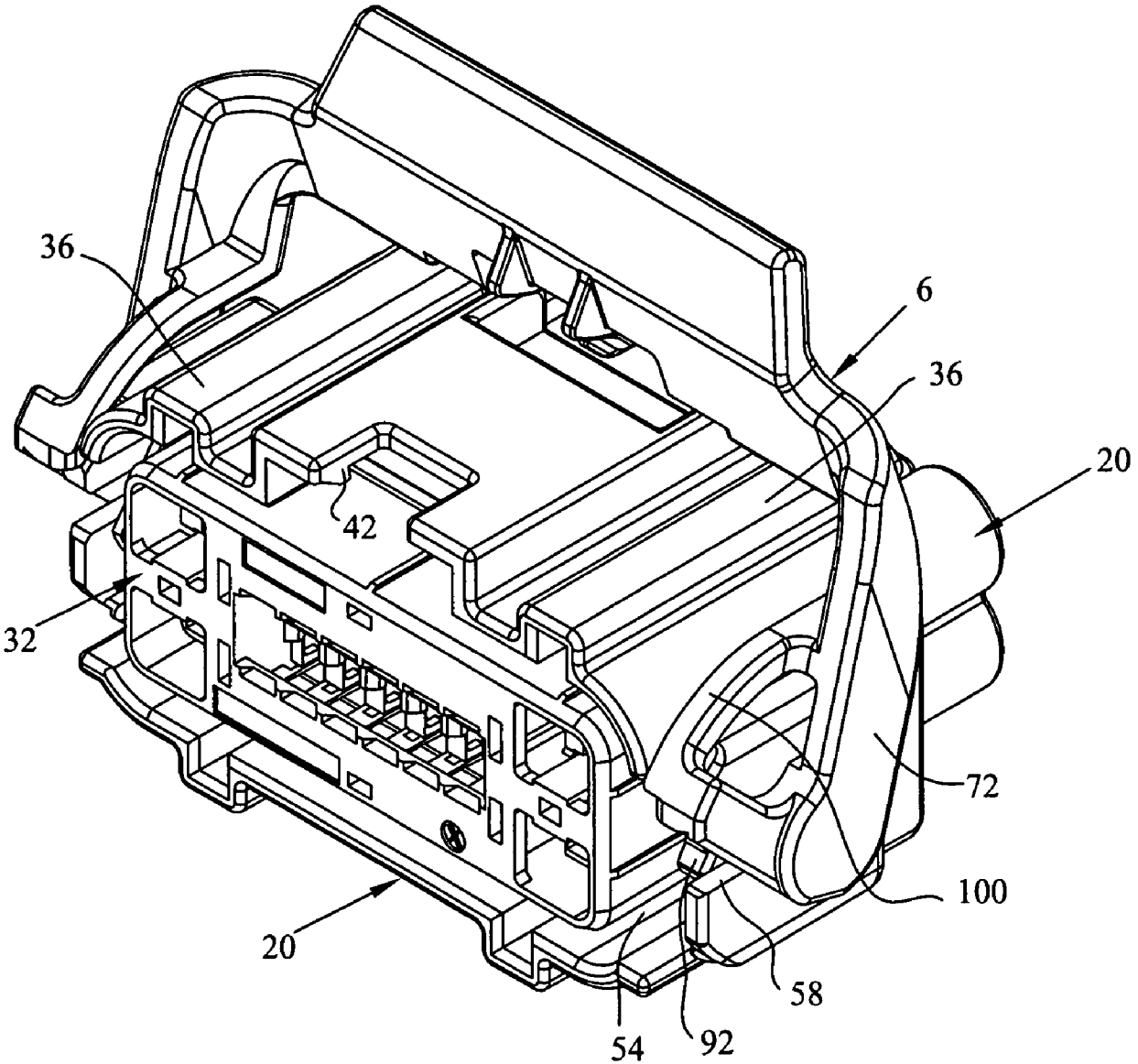
FIG. 8 shows the assembled view of the components of FIG. 4.

It should be appreciated that the axle portions 80 are profiled such that the flat surfaces 82 can be positioned between the narrowed passageways 58 (FIG. 4) with the circular portions 84 being rotatable within the enlarged circular bearing 60 (FIG. 4). With respect now to FIG. 8, connector housing 20 is shown with mating assist member 6 installed and rotated to an open position, whereby pinion tooth 92 is positioned within the channel 54 in an assist position and poised for interconnection with a mating connector, as will be described in greater detail herein.

Figure 9:
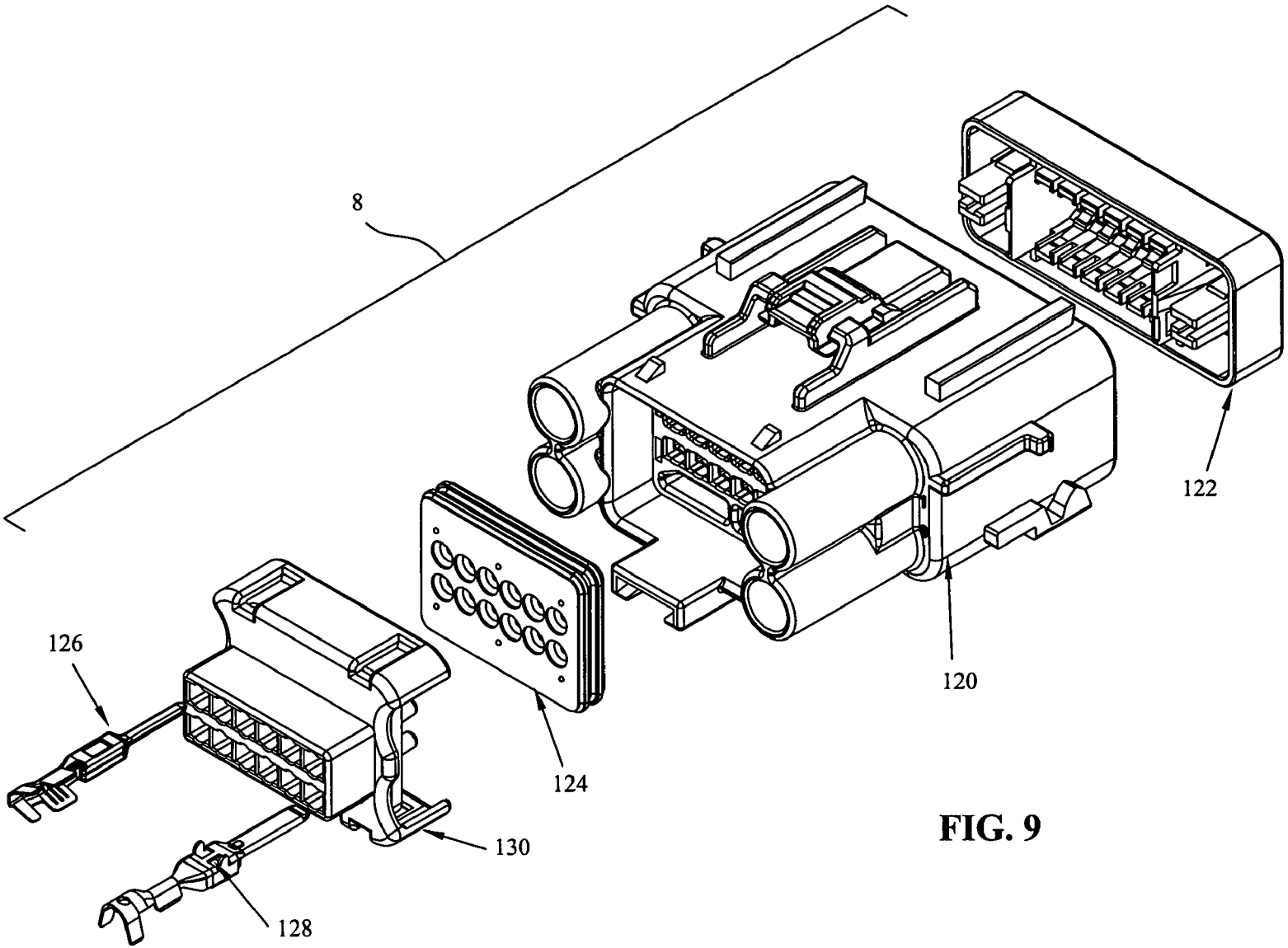
FIG. 9 shows an exploded view of the header or male connector, also shown in FIG. 1.
Figure 10:
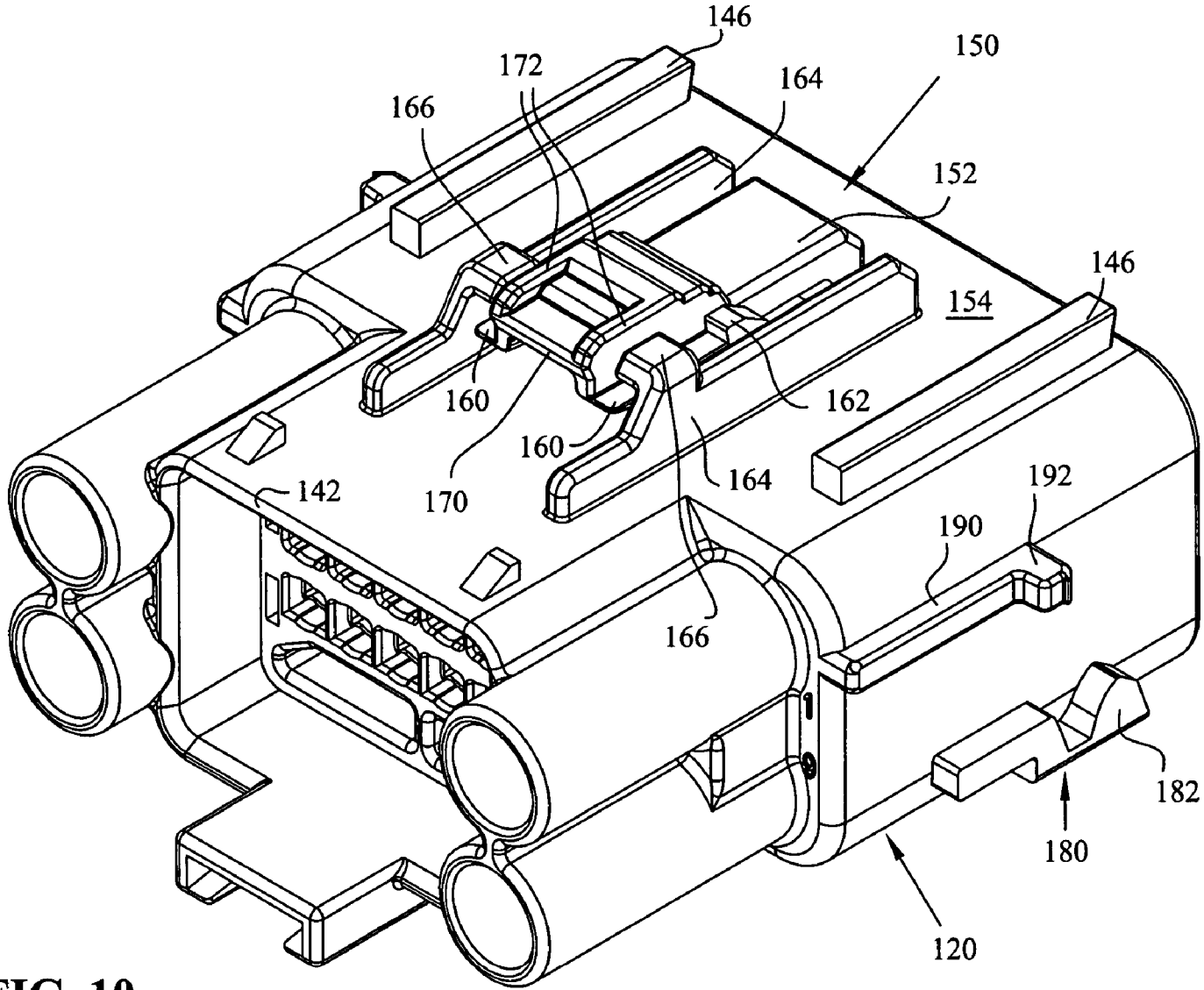
FIG. 10 shows an enlarged view of the housing portion of FIG. 9.
Figure 11:
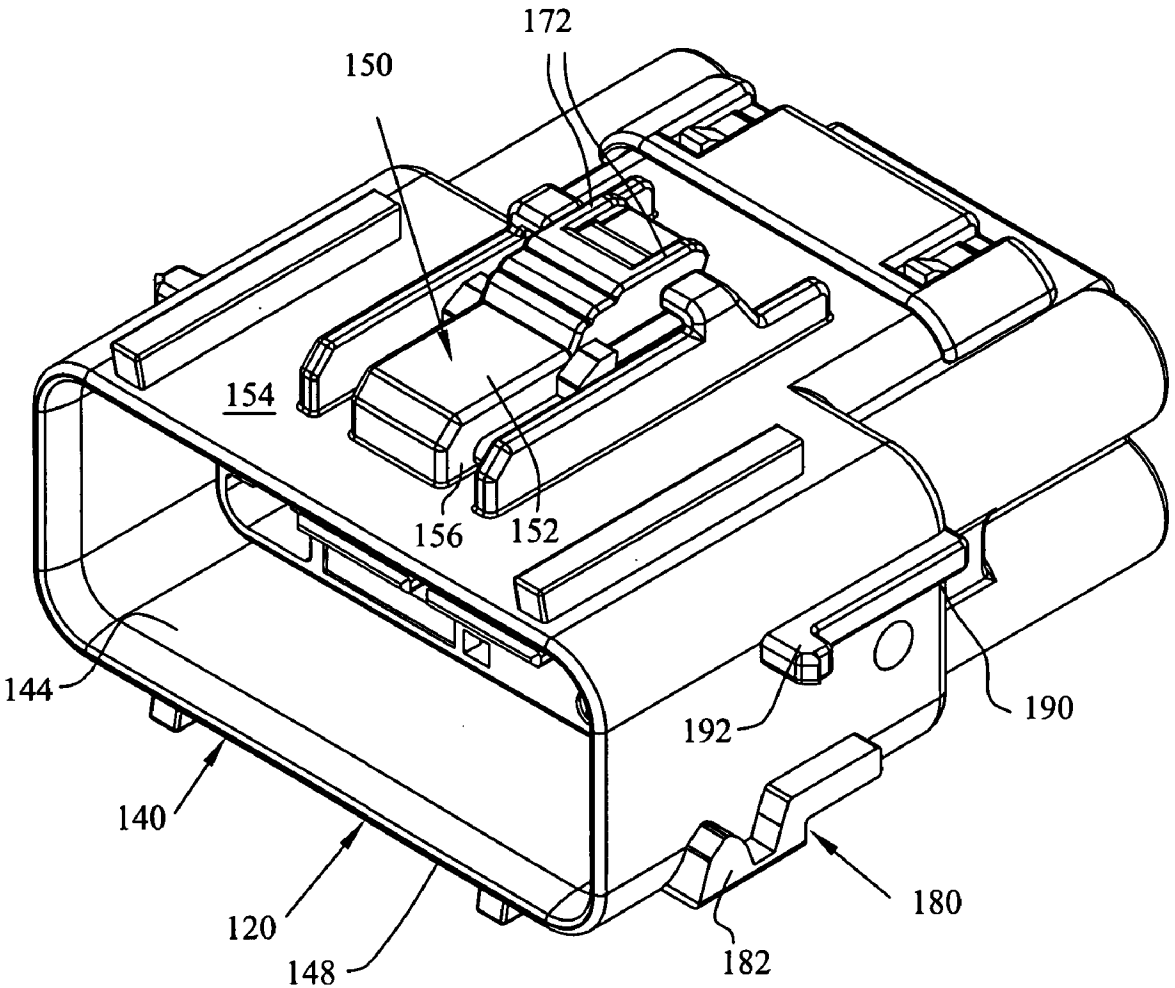
FIG. 11 shows the header assembly or male half of the connector from the opposite perspective as FIG. 10 shows the housing only.

With respect now to FIG. 9, header connector assembly 8 is shown in an exploded manner as including a housing portion 120, a terminal position assurance member (TPA) 122, a discrete wire seal 124, contacts or terminals 126 and 128, and rear cap 130. As shown in FIGS. 10 and 11, housing 120 includes a front end 140, and a rear wire-receiving end 142. Front end 140 includes a shrouded portion at 144, which is profiled to mate with the plug connector housing 20 with alignment ribs 146 positionable with alignment channels 36 (FIG. 4). Front end 140, further includes a leading edge 148, as best shown in FIG. 11.

Housing 120 further includes a latch member 150, as a component of latch assembly 10, which includes a cantilever beam portion 152 integrally connected to a top wall 154 by a web portion 156, and extends rearwardly of the housing 120. As shown best in FIG. 10, cantilever beam portion 152 includes side wall sections 160 having locking projections 162 upstanding therefrom. Two side wall sections 164 flank the cantilever beam portion 152 and include overstress members 166. As shown in FIG. 10, the extreme end of cantilever beam portion 152 includes an angled edge portion 170, which defines a contacting surface, whereas the top of the latch cantilever beam portion 152 includes two contact surfaces at 172.

Finally, as shown in either of FIG. 10 or 11, housing 120 includes a portion 180 which provides an engagement lug, in the form of a simulated gear rack including a first tooth 182, positioned on side wall 184. Housing 120 further includes alignment bars 190 having a locking extension at 192, again as will be described further herein.

Figure 12:
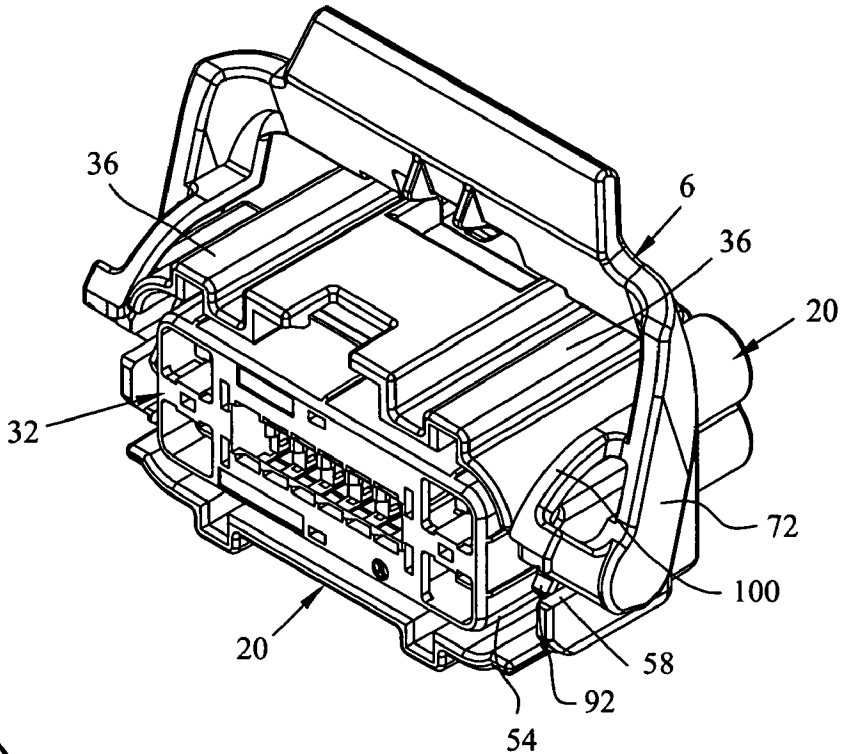
FIG. 12 shows a view showing the connectors of FIGS. 8 and 10 poised for interconnection.
Figure 12:
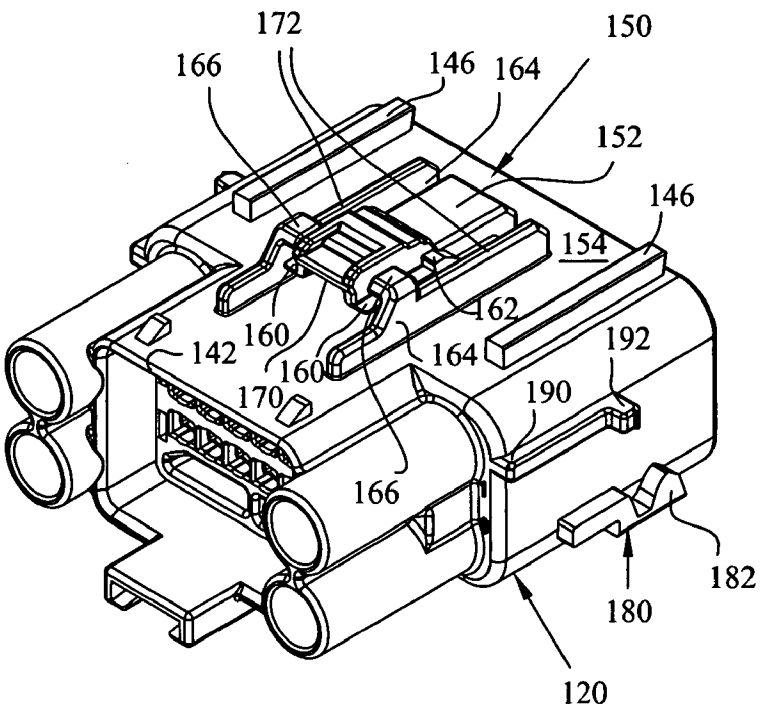

With both connector assemblies 4, 8 as described herein, the operation of the connector housings 20 and 120 will be described herein. As shown in FIG. 12, the two connector housings are mate able with the alignment ribs 146 aligning with the alignment channels 36, which positions locking extensions 192 in position in openings 106 (FIG. 6) of the mating assist member 6, and which positions rack tooth 182 in position to be received below pinion tooth 92. Thus, rotation of the mating assist member 6 in the counterclockwise sense (as viewed in FIG. 12) causes the engagement of the rack and pinion teeth 182, 92 causing the connectors to move into an interconnected state. At the same time, arcuate arm portions 100 rotate to entrap extensions 192.

Figure 13:
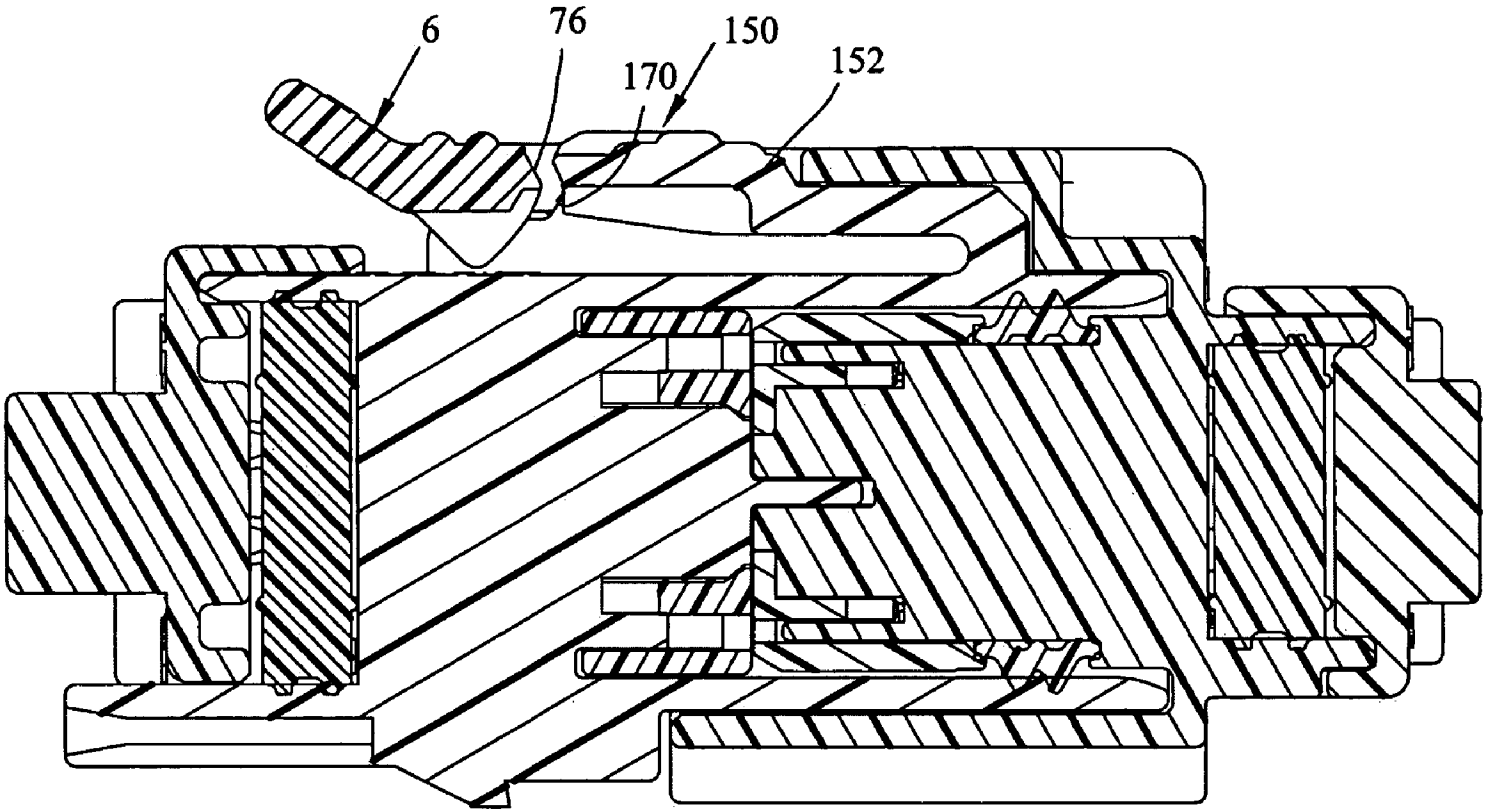
FIG. 13 shows a cross-sectional view through lines 13-13 of FIG. 1.

When the connectors are fully engaged, the connector pair is in the position of FIG. 1, and locking projections 162 are positioned behind locking projections 42. This also positions angled edge surface 170 in a close proximity to corresponding latching projection 76 on pivot-assist member as shown in FIG. 13. These two corresponding surfaces prevent disengagement between the two, as a counter-rotation of mating assist member 6 (that is in the clockwise position as viewed in FIG. 13) would cause the abutment of the latching projection 76 and edge surface 170 lifting latch member 150 into the overstress members 166 (FIG. 10).

Figure 14:
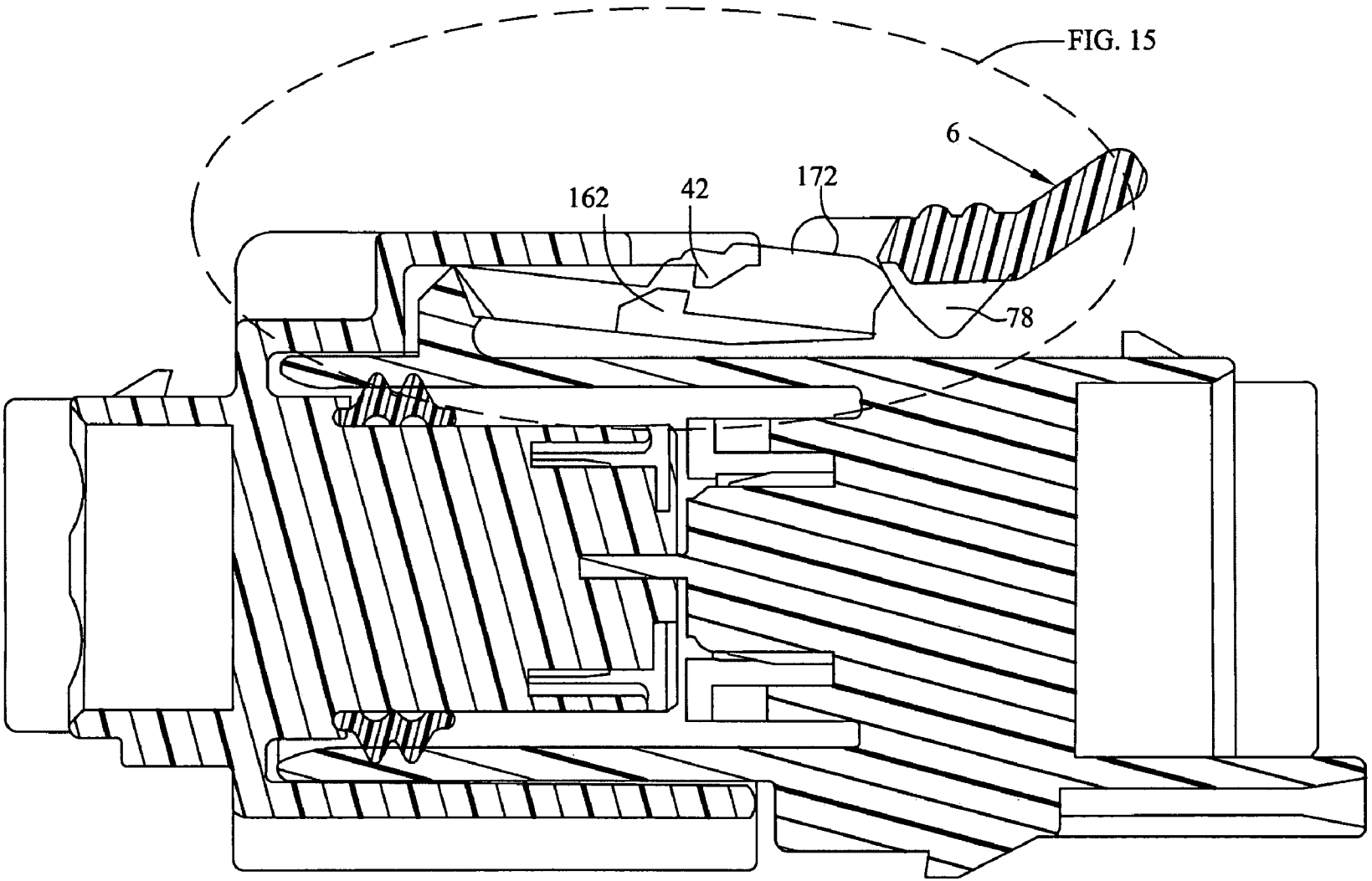
FIG. 14 shows the connectors of FIG. 13 in the initial disconnection state.
Figure 15:
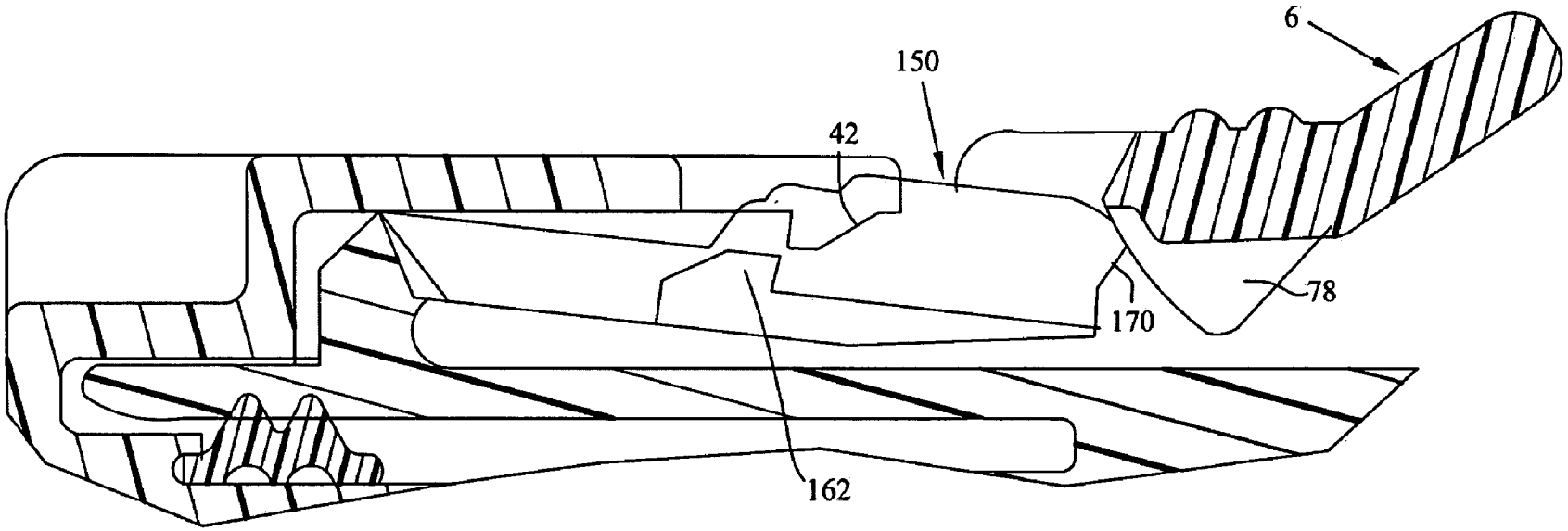
FIG. 15 is an enlarged view of the encircled portion on FIG. 14.
Figure 16:
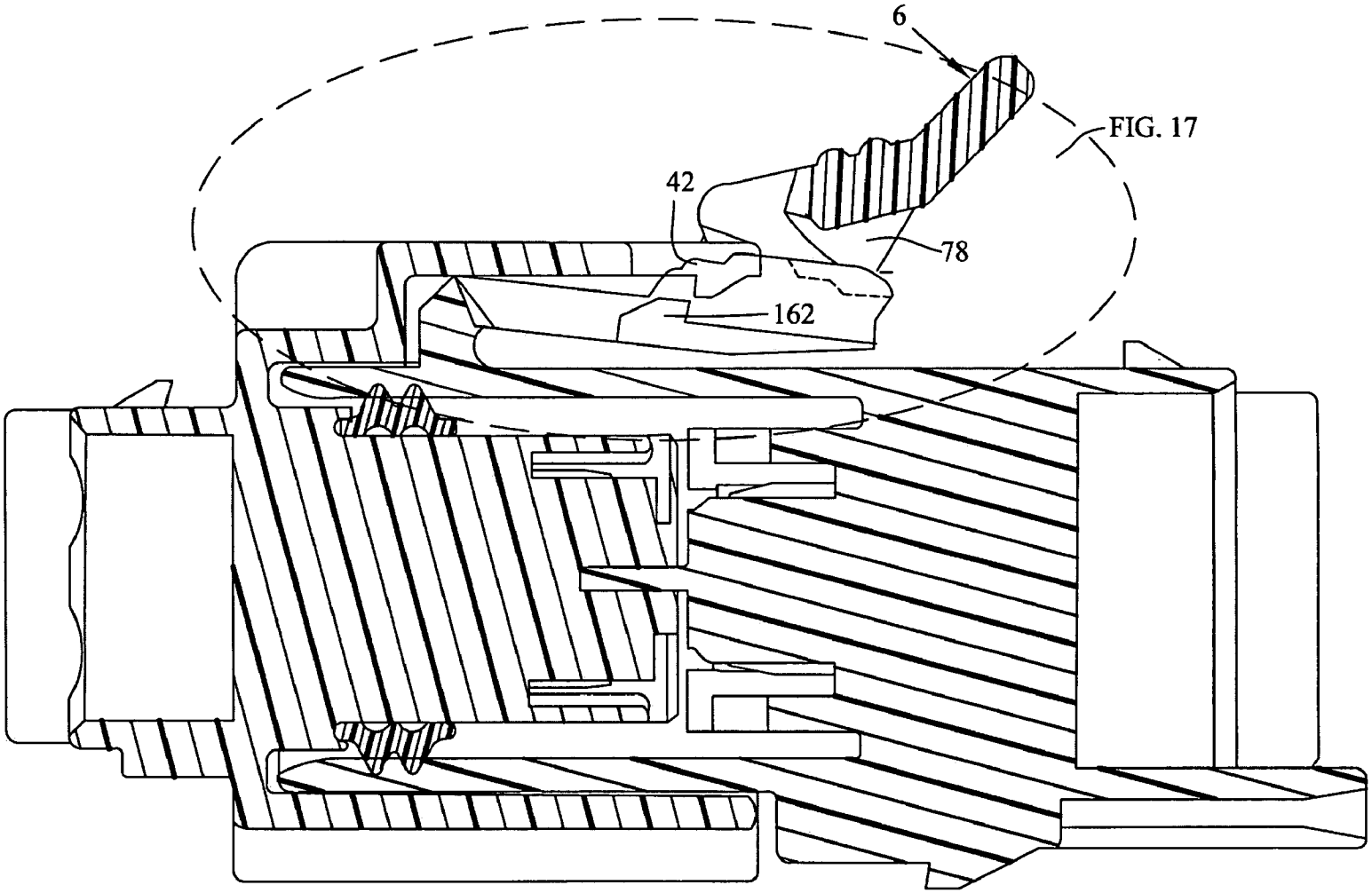
FIG. 16 is a cross-sectional view similar to that of FIG. 14 showing the connectors in a further disconnection state.
Figure 17:
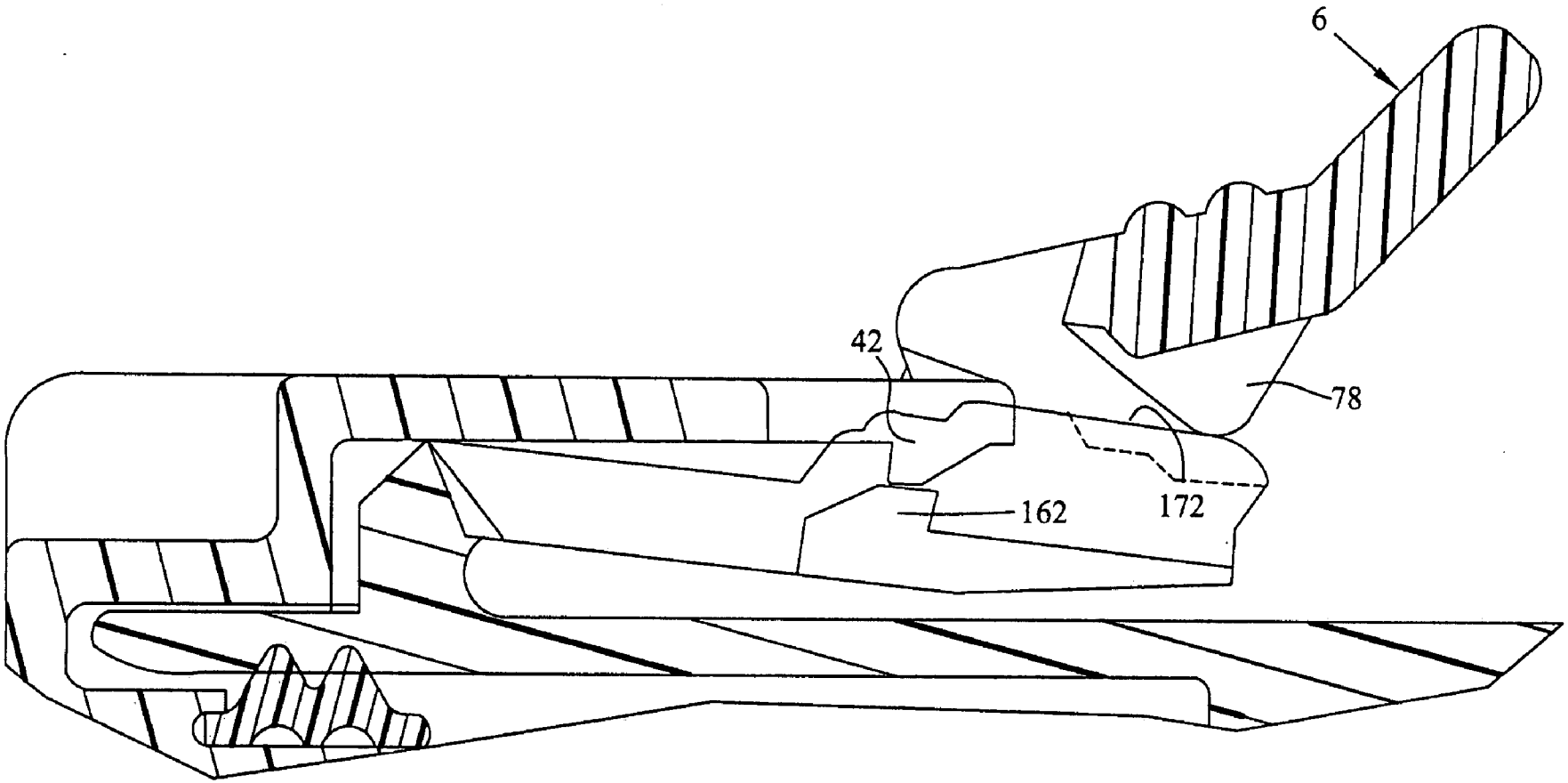
FIG. 17 shows an enlarged view of the encircled portion on FIG. 16.

At the same time, projections 78 assist in holding the latch member 150 down during the counter-rotation, allowing mating assist member 6 to be rotated without having to hold down latch member 150 by hand. With respect first to FIGS. 14 and 15, when the latch is initially depressed and the mating assist member 6 has begun a counter-rotation, in the counterclockwise sense as viewed in FIGS. 14 and 15, projections 78 have contoured surfaces which begin to ride up on surface 172, which holds the latch in the downward position such that locking projections 42 and 162 are clear of each other, as best shown in FIG. 15. Continued rotation of the mating assist member 6, to the position now shown in FIGS. 16 and 17, positions projection 78 further along on surface 172 and locking projection 162 has now cleared beneath locking projection 42, preventing snagging between the two connectors.

Figure 18:
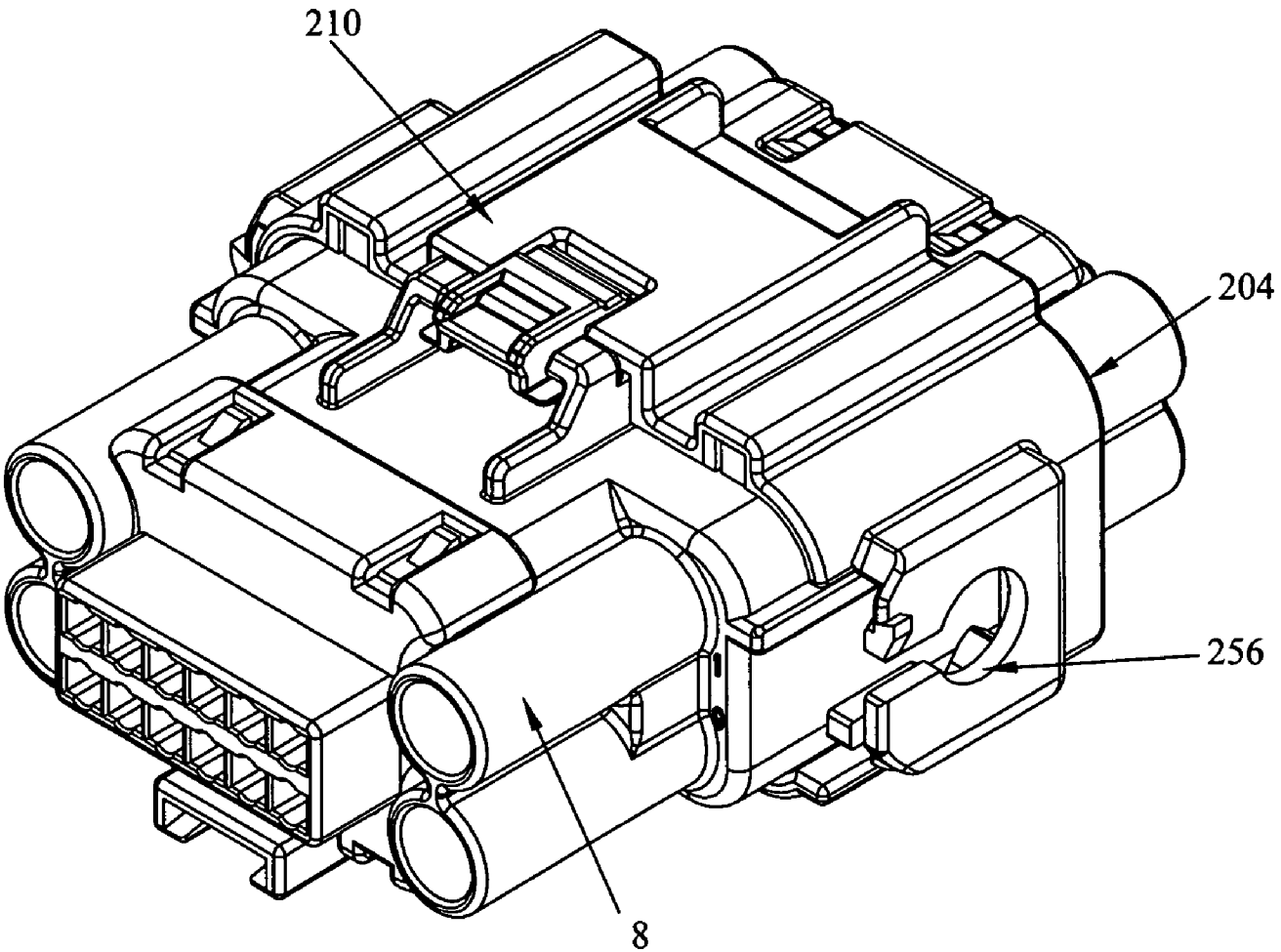
FIG. 18 shows an alternative plug housing, where the mating assist lever is not required.
Figure 19:
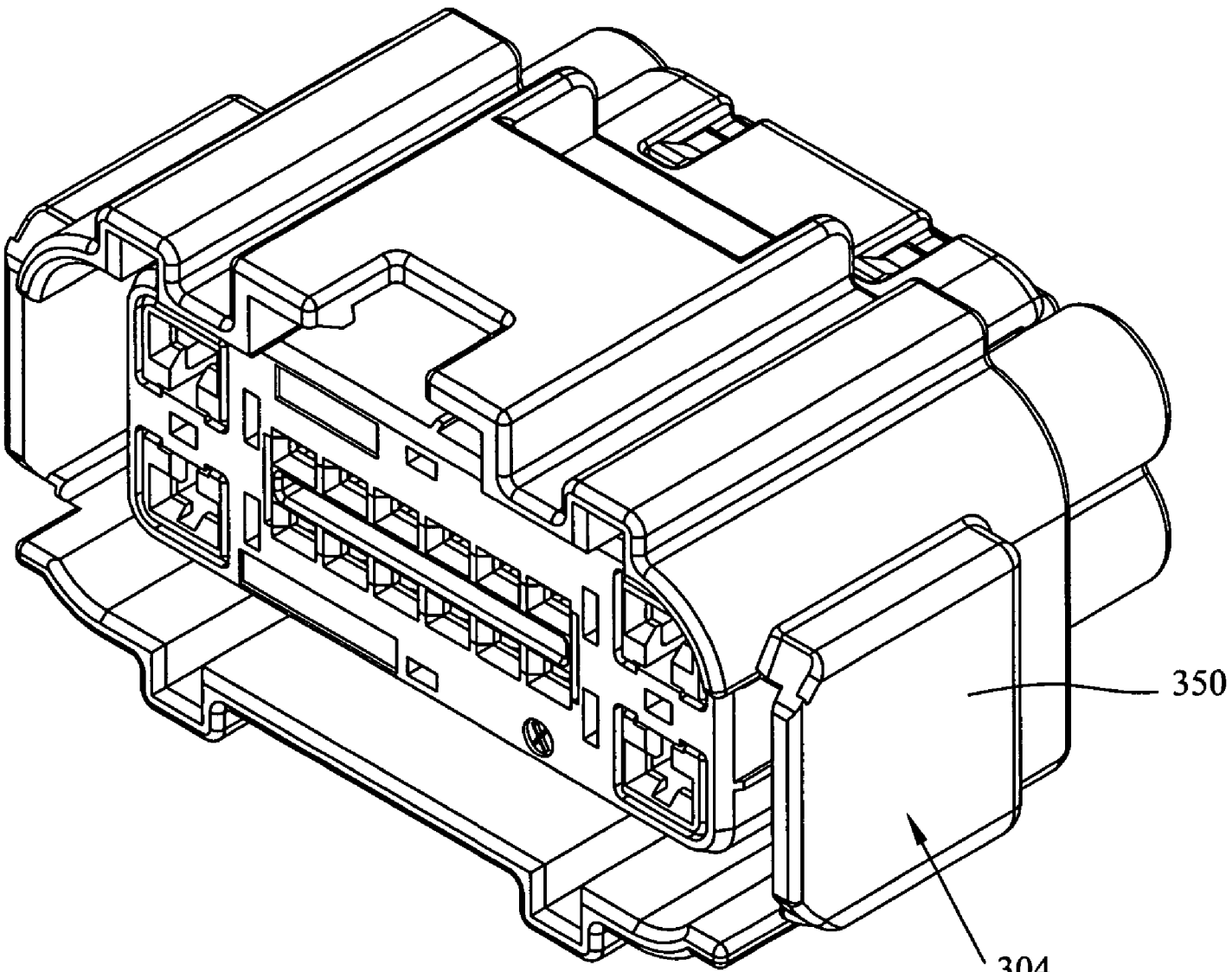
FIG. 19 shows an alternative plug housing having no mating assist lever required.

As mentioned above, depending upon the mating force between the two connectors (as a result of the number of terminals loaded), it is possible to have a connection pair that does not require the mating assist member 6, and two embodiments of the modified connection system are shown in FIGS. 18 and 19.

With respect first to FIG. 18, it is possible to have a connector housing, such as 204, which simply eliminates the mating assist member 6 leaving a mounting slot at 256 identical in nature to mounting slots 56 described above. In this configuration, the two connectors are simply connected together by hand, whereby the latch assembly 210 holds the two connectors together.

As shown in FIG. 19, a revised housing is shown at 304 having solid outer walls at 350, which eliminates any of the mounting slots 56 or 256. This is accomplished by simply eliminating the mold tooling, which forms the passageways 58 and circular bearing 60 of the embodiment shown in FIG. 4. This housing would work in almost identical nature to that shown in FIG. 18, whereby the two connectors are simply brought into engagement with each other and into a latched condition, as described above.

Advantageously, the connector assembly can easily accommodate multiple configurations for various numbers of terminals loaded in the connection system. As mentioned above, depending on the number of terminals loaded in the various connector assemblies, the mating forces between them may be above or below the USCAR 75 Newton threshold, which may require or not require the mating assist member 6. Thus, the design can easily accommodate either having or not having the lever-assist member by either simply eliminating it as in the FIG. 18 embodiment or by simply removing the side mold tooling as in the FIG. 19 embodiment. Other advantages are shown in our patent application, Ser. No. 11/075,596, concurrently filed and incorporated herein by reference.

What is claimed is:

1. An electrical connector assembly, comprising:

a first connector housing, comprising:

a first exterior profile, said exterior profile having at least a pair of engageable lugs positioned adjacent to a leading edge of said first connector housing; and a first latch member positioned adjacent to said leading edge of said first connector housing; and a second connector housing comprising:

a second exterior profile, profiled for overlappingly receiving said first exterior profile;

a pair of channels to receive said at least one pair of engageable lugs on said first connector housing; and a second latch member positioned on said second exterior profile for latching engagement with said first latch member of said first connector housing;

said pair of channels having a plurality of configurations, wherein said plurality of configurations include:

each channel includes an exterior wall which receives one of said pair of engageable lugs therein; or each channel includes a mounting wall having a mating assist member attached thereto, said mating assist member being cooperable with said pair of engageable lugs to move said first and second connector housings into mated condition.

2. The electrical connector assembly of claim 1, wherein said first latch member is profiled as a cantilever beam extending rearwardly away from said leading edge.

3. The electrical connector assembly of claim 2, wherein said second latch member is comprised of a raised wall, said cantilever beam of said first latch member being receivable into an area beneath said raised wall.

4. The electrical connector assembly of claim 3, wherein said first and second latch members include first and second cooperating latching projections.

5. The electrical connector assembly of claim 4, wherein said first latching projection projects upwardly from said cantilever beam, and said second latching projection projects downwardly from said raised wall.

6. The electrical connector assembly of claim 3, wherein said pair of engageable lugs are positioned on side walls of said first connector housing, and said first latch extends from a top wall.

7. The electrical connector assembly of claim 6, wherein said mating assist member is a lever arm.

8. The electrical connector assembly of claim 7, wherein said lever arm is comprised of side arms attached to said mounting wall, and an upper arm spanning across said top wall.

9. The electrical connector assembly of claim 8, wherein said lever arm snaps in place behind said cantilever beam when in the fully mated position.

10. The electrical connector assembly of claim 9, wherein said engageable lugs and said lever arm are profiled as rack and pinion teeth.

* * * * *